US007748065B2

(12) United States Patent
Edling

(10) Patent No.: US 7,748,065 B2
(45) Date of Patent: Jul. 6, 2010

(54) END SEPARATED POCKETED MATTRESS AS WELL AS METHOD AND DEVICE FOR MANUFACTURING THE SAME

(75) Inventor: Kenneth Edling, Herrljunga (SE)

(73) Assignee: Stjernfjadrar AB, Herrljunga (SE)

( * ) Notice: Subject to any disclaimer, the term of this patent is extended or adjusted under 35 U.S.C. 154(b) by 406 days.

(21) Appl. No.: 11/547,800

(22) PCT Filed: Apr. 26, 2005

(86) PCT No.: PCT/SE2005/000598

§ 371 (c)(1),
(2), (4) Date: Apr. 16, 2007

(87) PCT Pub. No.: WO2005/102115

PCT Pub. Date: Nov. 3, 2005

(65) Prior Publication Data

US 2007/0289068 A1 Dec. 20, 2007

(30) Foreign Application Priority Data

Apr. 26, 2004 (SE) ..... 0401061

(51) Int. Cl.
*A47C 27/06* (2006.01)

(52) U.S. Cl. ..... 5/720; 5/655.8; 29/91.1; 53/114; 53/450

(58) Field of Classification Search ..... 5/720, 5/655.8, 716; 267/91; 29/91.1, 525.01, 428; 53/114, 450, 436, 438
See application file for complete search history.

(56) References Cited

U.S. PATENT DOCUMENTS

| | | | | |
|---|---|---|---|---|
| 3,633,228 | A * | 1/1972 | Zysman | 267/152 |
| 5,319,815 | A * | 6/1994 | Stumpf et al. | 5/720 |
| 6,591,438 | B1 | 7/2003 | Edling | |
| 2004/0025257 | A1 | 2/2004 | Ahlqvist | |

FOREIGN PATENT DOCUMENTS

| | | |
|---|---|---|
| DE | 9012069 | 12/1990 |
| DE | 202 15 963 | 6/2003 |
| EP | 1410744 | 4/2004 |
| WO | WO 00/58203 | 10/2000 |

OTHER PUBLICATIONS

English translation of Russian Office Action issued in connection with corresponding application.
International Search Report (PCT/ISA/210).

* cited by examiner

*Primary Examiner*—Alexander Grosz
(74) *Attorney, Agent, or Firm*—Harness, Dickey & Pierce, P.L.C.

(57) ABSTRACT

A spring mattress is described, including a plurality of strings interconnected side by side. Each string includes a plurality of continuous casings and, enclosed therein, coil springs. Moreover, between at least some of the springs in at least one of the strings a slot is arranged which opens towards the upper or lower side of the mattress. It is preferred for the springs between which the slot is arranged to be separated with an intermediate separation distance, which separation distance exceeds about 10% of the diameter of the largest turn of the adjoining springs. In addition, it is preferred for the casing portions to be arranged at the ends of the spring to be moved towards each other, through the spring, and connected to each other by at least one connecting device.

21 Claims, 5 Drawing Sheets

END SEPARATED POCKETED MATTRESS AS WELL AS METHOD AND DEVICE FOR MANUFACTURING THE SAME

PRIORITY STATEMENT

This application is the national-phase under 35 U.S.C. §371 of PCT International Application No. PCT/SE2005/000598 which has an International filing date of Apr. 26, 2005, which designated the United States of America and which claims priority on Swedish Patent Application number 0401061-7 filed Apr. 26, 2004, the entire contents of which are hereby incorporated herein by reference.

FIELD

The present invention generally relates to a spring mattress. For example, it may relate to one comprising springs enclosed in casings, referred to as a pocket mattress. It also generally relates to a method and a device for manufacturing such a mattress.

BACKGROUND ART

A common technique of making spring mattresses is the so-called pocket technique. This means that the springs are enclosed in pockets, i.e. they are individually enclosed by a casing material. In this way, the springs will be relatively individually resilient so that they can flex individually without affecting the neighboring springs and, thus, the comfort to the user increases since his weight will be distributed more uniformly over the surface that receives the load.

A drawback of such mattresses is, however, that they are significantly more expensive to manufacture than many other types of spring mattresses.

Therefore there is a need for a mattress which is easier and/or less expensive to manufacture but which at the same time provides an equivalent comfort compared with other prior-art pocket mattresses.

This drawback is partly eliminated by the mattress disclosed in WO 02/44077 by the same applicant. This mattress comprises strings, in which the springs are more separated than has been known so far. This has been found not only economically advantageous, but the mattress has also been found to be comfortable to the same extent as prior-art mattresses. However, in this solution it is still difficult to obtain the desired individual resilience of the individual springs.

Another drawback of prior-art pocket mattresses is also that in such mattresses it is difficult to provide thin mattresses. If the length of the springs is reduced without a corresponding reduction of the width, the spring will, especially when the length approaches the length of the diameter of the spring, have a tendency to turn in the casing, which dramatically deteriorates the comfort of the mattress. When such mattresses are to be manufactured, the existing technique requires a much larger number of springs. Consequently the manufacture will be considerably more expensive and more complicated. Besides it is difficult to prevent such mattresses from also being stiffer since too thin spring wire cannot be used.

For these reasons, it has not been possible to use spring mattresses for many purposes where thinner mattresses are required, such as for bed mattresses, seat cushions and the like. In spite of this, spring mattresses have several properties making it desirable to use them also in these contexts, such as excellent comfort, individual flexibility, a long life and easy and inexpensive manufacture.

A solution to this problem has been presented by the same applicant in WO 00/58203. In this solution, the end portions of the casings are moved towards each other, which gives a bias of the springs, and a very compact and useful mattress. A drawback of this mattress is, however, that it is relatively complicated and expensive to manufacture. Moreover the moving together of the end portions counteracts the normally desired individual and independent resilience of the individual enclosed springs.

SUMMARY

It is therefore an object of at least one embodiment of the present invention to provide a spring mattress, as well as a method and device for manufacturing the same, in which the above related drawbacks are eliminated wholly or at least partly.

This object may be achieved, in at least one embodiment, by a spring mattress and/or a method for manufacturing the same.

In one aspect of an embodiment of the invention, a spring mattress is provided, comprising a plurality of strings interconnected side by side, each string comprising a plurality of continuous casings and, enclosed therein, coil springs. Moreover, between at least some of the springs in at least one of the strings a slot is arranged which opens towards the upper or lower side of the mattress.

Owing to the slot between the springs, there is less actuation between the springs as they are pressed down, thereby significantly increasing the individual and independent resilience of the springs. This has resulted in a relatively simple and cost-effective mattress with a considerably improved comfort compared with prior-art pocket mattresses.

Preferably, slots are arranged between substantially all springs in at least one of the strings, and most preferred in substantially all strings. As a result, the individual resilience over substantially the entire mattress surface is provided with relatively simple means.

The slots can be arranged so as to open towards only one of the sides of the mattress. This results in different properties on the different mattress sides, which may be advantageous since the user can thus choose mattress properties as desired by turning the mattress to the desired position. Alternatively, however, slots can be arranged on both sides, which means that the mattress can have the same properties, no matter how it is turned.

It has also been found particularly advantageous to arrange the above-mentioned slots in mattresses where the springs are separated. In particular the springs between which the slot is arranged can be separated with an intermediate separation distance (SA), which separation distance exceeds about 10% of the diameter of the largest turn of the adjoining springs, and preferably exceeds 15% of the diameter of the largest turn, and most preferred exceeds 20%.

This combines the advantages of the separated pocket mattress as disclosed in WO 02/44077, and the enhanced comfort achieved through the slots. The result has appeared to be a surprisingly comfortable and cost-effective pocket mattress.

In this type of separated mattress, the slot can be arranged within a separation distance which is provided by a connection, extended in the longitudinal direction of the strings, of the casing material between the springs, the slot being arranged in said extended connection. Alternatively, the slot can be arranged in a separation distance which is provided by two separated joint lines arranged between the springs, the slot being arranged between said joint lines.

Moreover it has been found advantageous in the above defined type of mattress to let the casing portions arranged at the ends of the spring be moved towards each other, through the spring, and be connected to each other by at least one connecting device.

This combines the above related advantages with the advantages achieved by the mattress disclosed in WO 00/58203. Thus a thin pocket mattress is obtained, which at the same time exhibits surprisingly good individual resilient properties and, thus, an unexpectedly good comfort. The slots between the springs also reduce the effect that the springs are pulled towards each other when the end portions are moved together. This allows a mattress of this type with fewer springs. In cases when a separation distance has been introduced between springs in the strings, the slots thus ensure that the separation can be kept also in the biased position, which allows a more cost-effective mattress, with fewer springs, of this biased, thin type.

In such a mattress with fewer springs, it is possible to use a greater wire thickness of the coil springs and still achieve the same softness of the mattress as in a corresponding mattress where the springs are positioned more closely together. This is advantageous since it is usually both less expensive and easier to handle thick wire coil springs than to handle thin wire coil springs. Alternatively, it is possible in the above-defined mattress to obtain enhanced softness compared with prior-art mattresses of the same thickness. This is favorable since it has previously been complicated and sometimes even impossible to obtain the requested softness of the prior-art mattresses of this type.

In particular it is advantageous in this mattress if the casing portions are moved so far towards each other as to make contact with each other.

To connect the end portions to each other, different types of connecting devices can be used. However, the connecting devices preferably include a mechanical connecting element, such as clamps, or a surface joint, such as gluing or welding.

In a second aspect of an embodiment of the invention, a method is provided for manufacturing the mattress discussed above. This method for manufacturing a spring mattress comprises the steps of enclosing springs in casings in continuous strings;

interconnecting the strings side by side;

and, before or after the preceding steps, arranging a slot between at least some of the springs in at least one of the strings, said slot opening towards the upper or lower side of the mattress.

This results in advantages equivalent to those of prior-art technique as discussed above.

In a further aspect of an embodiment of the invention, a method for manufacturing the mattress discussed above is provided. This device for manufacturing spring mattresses comprises means for enclosing coil springs in continuous casings to form strings;

means for interconnecting strings side by side; and means for arranging slots between springs in such strings, said slots being open towards the upper or lower side of the mattress.

With this device, advantages equivalent to those discussed above with respect to the mattress are achieved.

It is particularly preferred for the device to include at least one device for biasing the springs enclosed in the strings. The at least one device for biasing can advantageously comprise at least one insertion device and, arranged at a distance therefrom, at least one oppositely extending device, the insertion device and the oppositely extending device being adapted to perform a relative displacement motion towards and away from each other to move casing materials, at the ends of a spring arranged therebetween, towards each other through the spring, and fixing means for arranging connecting members which interconnect the thus moved together casing materials from the two ends of the spring.

These and other advantages of the current invention will be evident from the following detailed description of example embodiments.

BRIEF DESCRIPTION OF THE DRAWINGS

In the accompanying drawings

DESCRIPTION OF EXAMPLE EMBODIMENTS

For the purpose of exemplification, the invention will now be described in more detail by way of an embodiment and with reference to the accompanying drawings.

Figure 1:
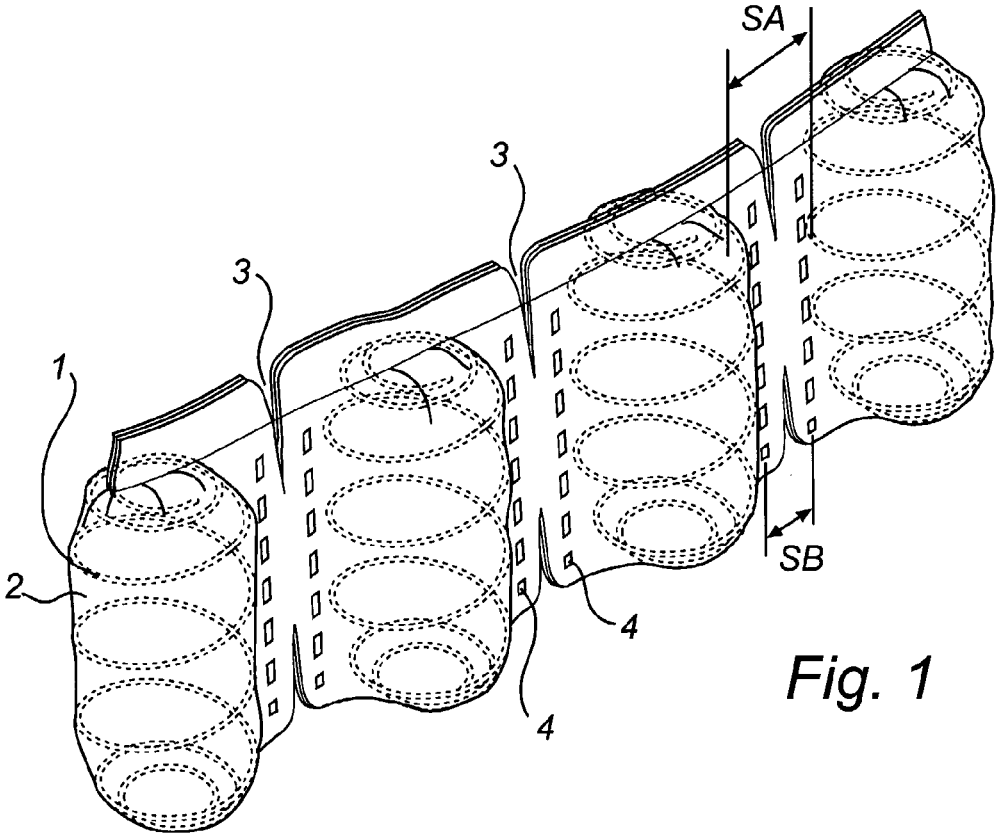
FIG. 1 is a perspective view of a string obliquely from above, in which the springs are not biased, for manufacturing a mattress according to an embodiment of the invention.
Figure 2:
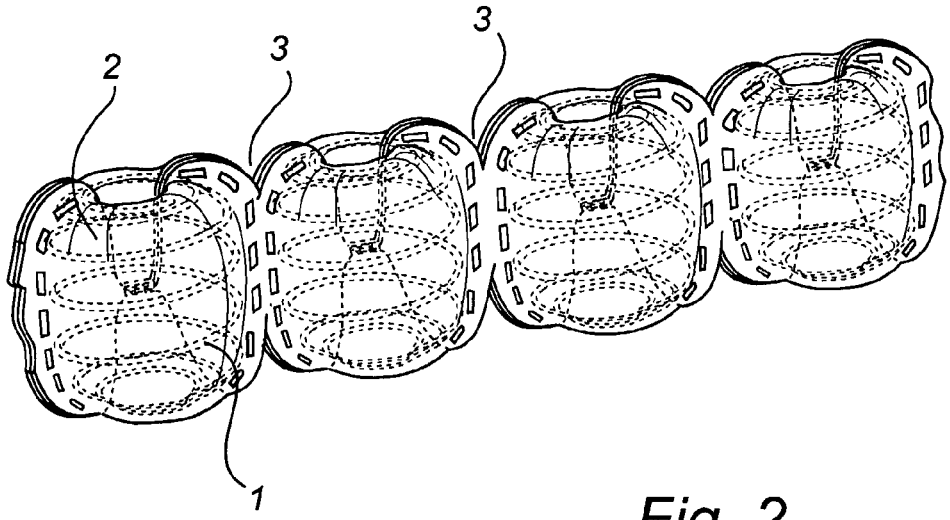
FIG. 2 is a perspective view of a string obliquely from above, in which the springs are biased, for manufacturing a mattress according to an embodiment of the invention.

A spring mattress according to an embodiment of the invention includes a plurality of interconnected coil springs 1 enclosed in casings 2, as shown in FIGS. 1 and 2. The casing is suitably made of a, preferably weldable, textile material, but also other materials, such as different types of plastic materials, can be used. It is also possible to use non-weldable textile materials, such as cotton cloth. Such mattresses, referred to as pocket mattresses, are previously known, and therefore the manufacture thereof is not part of the present invention. Normally, strings of interconnected pocket springs in casings are manufactured automatically, after which these strings are cut in suitable lengths and joined side by side to form mattresses.

Moreover, in at least one of the sides of the mattress, preferably in both sides, slots 3 are arranged between the springs. These slots are open towards one of the mattress sides and extend down between the springs. Preferably the slots have an extent which is greater than 1/10 of the extent of the casing in the longitudinal direction, and most preferred about 1/3 of this extent. Preferably the slots are of such an extent that the remaining continuous casing therebetween has an extent which substantially corresponds to the height of the biased springs of the completed mattress, in the case where the mattress is of the type where the end portions are moved towards each other (see below).

Coil springs of many sizes can be used in connection with an embodiment of the present invention, and basically any size of the springs can be used. However, it is preferred to use springs with a diameter of 2-10 cm, and most preferred about 6 cm. The springs include preferably at least four turns, and preferably less than 10 turns. Moreover they are advantageously made of spiral wire with a thickness in the range of 0.5-3.0 mm, and preferably a wire thickness in the range of 1.25-2.50 mm.

In the spring mattress, at least two adjoining springs are advantageously arranged with an intermediate separation distance SA, which separation distance exceeds 10% of the diameter of the largest turn of the adjoining springs, and preferably exceeds 15%, and most preferred exceeds 20%. Further the separation distance is preferably greater than 1 cm. Preferably also the casings enclosing the adjoining springs are arranged with an intermediate separation distance SB, which separation distance exceeds 10% of the diameter of the largest turn of the adjoining springs, and preferably exceeds 15%, and most preferred exceeds 20%. Moreover the separation distance SB is also greater than 1 cm.

Preferably such separation distances are arranged between substantially all springs in the longitudinal direction of the mattress. This can be achieved by the strings being provided with two joint lines 4, such as weld joints, to join the casing material on both sides of the springs, which are separated in the longitudinal direction of the strings, as illustrated in FIGS. 1 and 2. Alternatively, it is possible to provide one or more connections, extended in the longitudinal direction of the strings, of the casing material on both sides of springs, such as a wide weld joint (not shown). It is also possible to arrange continuous weld lines instead of spot weld joints (not shown). It is also possible to arrange other types of joints, such as one or more seams.

However, it is also possible to arrange the separation between the springs in other ways, such as by insertion of separating elements between the strings or the like.

According to an embodiment of the invention, mattresses having a length of about 198 cm may comprise less than 30 springs, and most preferred about 25 springs. It is also preferred for mattresses according to an embodiment of the invention to have a spring frequency in the longitudinal direction/directions where the separation distances are inserted, which is less than 15 springs per meter, and preferably less than 13 springs per meter. However, many other sizes of mattresses are of course conceivable.

Figure 3:
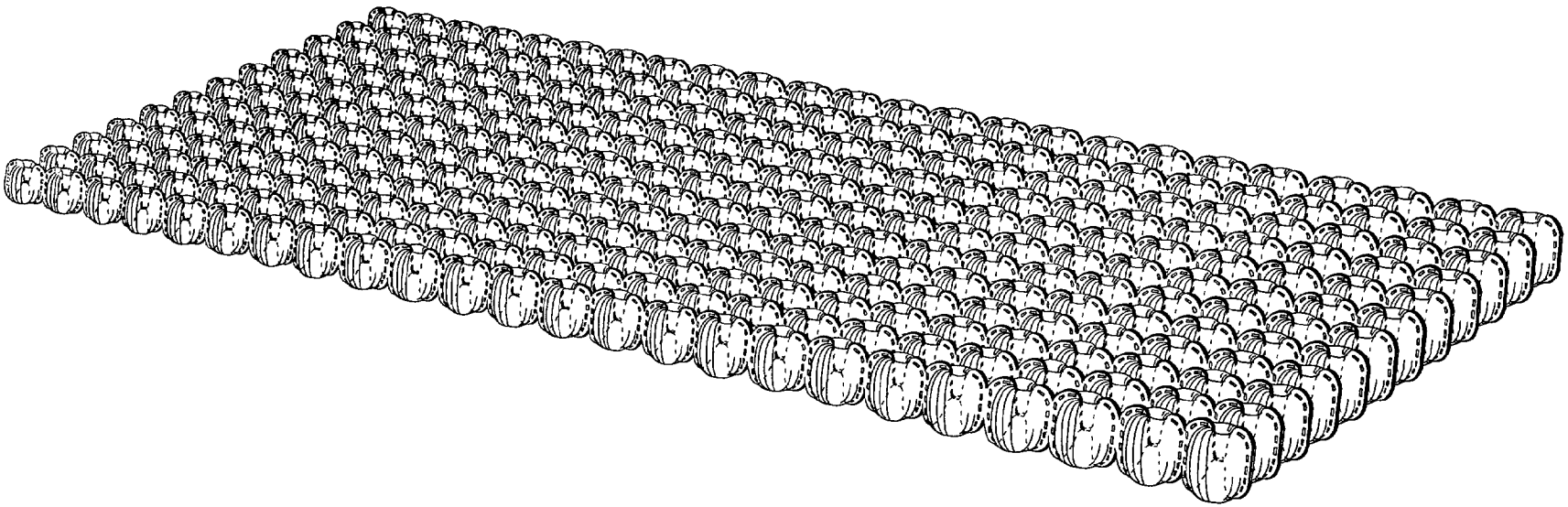
FIG. 3 is a perspective view of a mattress obliquely from above with biased springs according to a first embodiment of the invention.

In an example embodiment, for at least one of the springs, the casing portions are, at the spring ends, arranged moved towards each other, through the spring, and connected to each other by at least one connecting device to provide at least a certain degree of bias, as shown in FIGS. 2 and 3. Preferably, the casing portions are moved so far towards each other as to make contact with each other, but it is of course possible to interconnect them also otherwise, by way of wire, a long clamp or the like. The connecting device may include a mechanical connecting element, such as a clamp, a rivet or the like, or a surface joint, such as glue, a welding seam or the like. Other fixing elements are, however, also conceivable. The load exerted on the fixing element is normally small since the fixing elements are only loaded if the mattress is unloaded, whereas there is no load at all if the mattress is loaded.

FIG. 3 shows a mattress made of strings, in which the springs have been separated and biased by moving the end portions of the casings together, as discussed above, and as illustrated in FIG. 2. In this embodiment, slots make it possible to maintain the separation between the springs also in the biased state.

Figure 4:
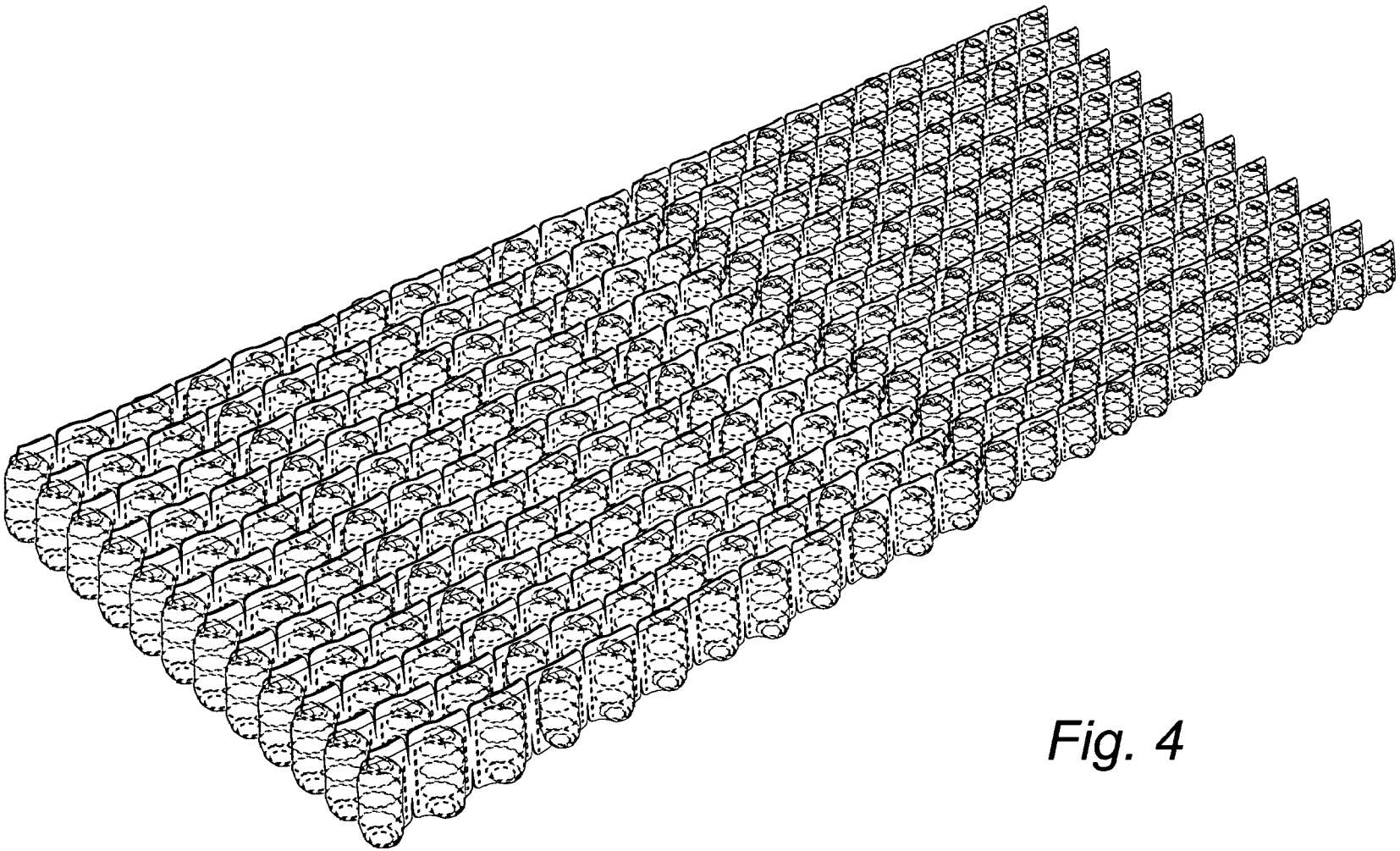
FIG. 4 is a perspective view of a mattress obliquely from above with non-biased springs according to a second embodiment of the invention.

FIG. 4 shows a mattress in which the springs have been separated, but where no bias as described above has occurred, as shown in FIG. 1. In this embodiment, the slots ensure an enhanced individual resilience of the enclosed individual springs.

The mattress according to an embodiment of the invention can be manufactured by the steps of enclosing springs in a casing material, arranging slots between at least some of the springs, optionally biasing at least one of the springs and connecting the springs to each other. By the step of biasing the springs is, in this case, meant moving casing portions arranged for the ends of the spring towards each other and interconnecting them by connecting elements. This bias can occur either immediately after encapsulating the springs in the casing material, i.e. before assembling them to form a mattress, or when the mattress has been assembled. However, the bias preferably occurs when the springs are positioned in strings, and bias of all springs in the mattress layer suitably occurs in this manner.

The arrangement of the slots may occur before the insertion of the springs into the casing material, after the insertion of the springs but before an optional bias and the joining of the strings, after the bias but before the joining of the strings, or after such joining. However, the arrangement of the slots advantageously occurs after the insertion of the springs but before the additional steps.

In the manufacture of mattresses, it may also, as discussed above, be ensured that at least two adjoining springs are connected to each other so that an intermediate separation distance is provided between the springs.

Owing to the above-described type of joining of the strings just in front of the springs in each string, the separation distances will be aligned with each other. This is preferred although it is also possible to arrange the strings so that the springs are offset relative to each other. In the latter case, also the springs all over the mattress can be arranged more closely to each other than in conventional pocket mattresses, even if this is usually not desirable.

It is also possible to use different separation distances, different biases and/or different slots over different zones or areas of the mattress, and, for instance, use larger separation distances in zones which in normal use are less loaded, and smaller separation distances in more loaded zones. It is also possible to provide different properties on both sides of the mattress.

Figure 5:
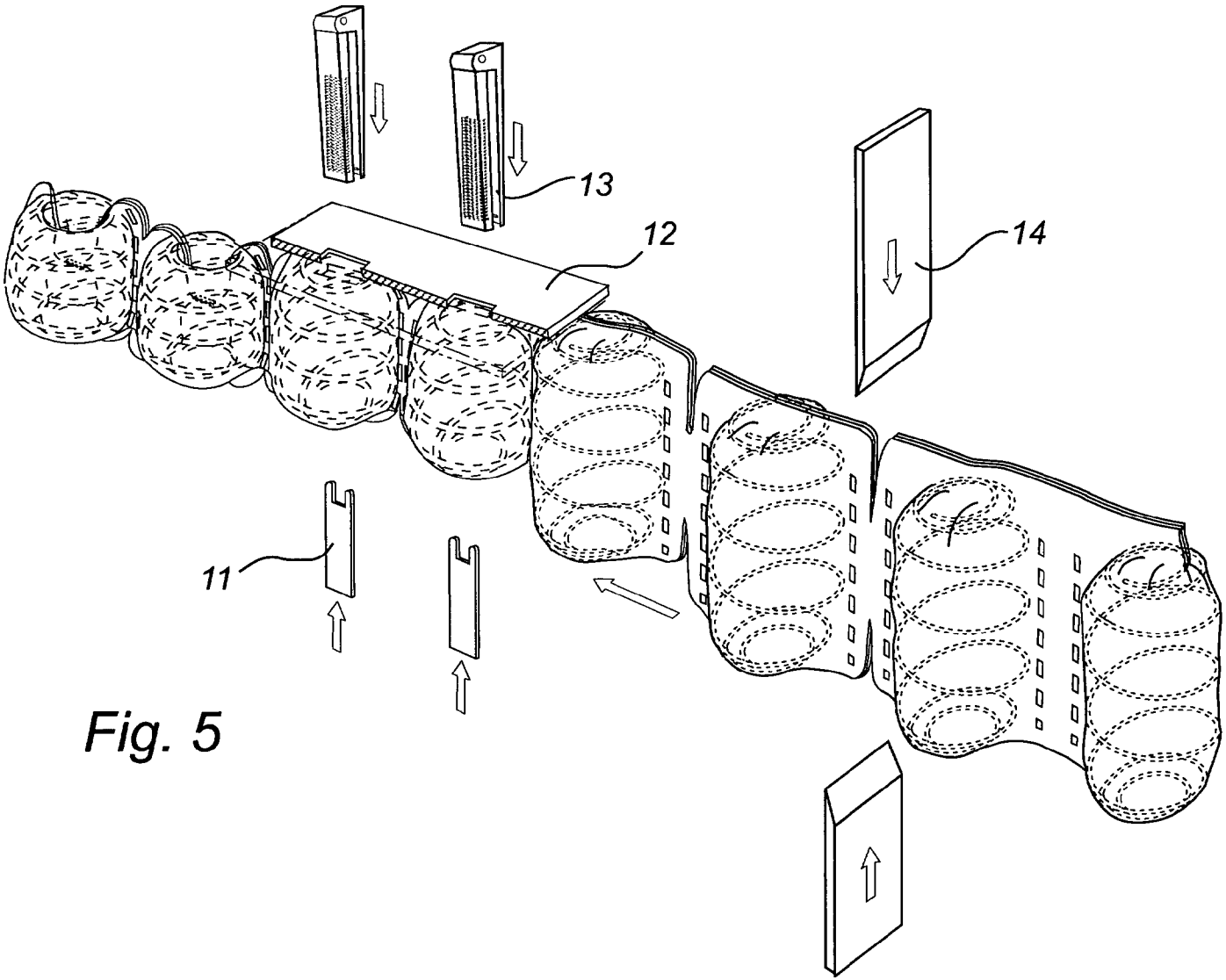
FIG. 5 is a schematic perspective view obliquely from above of a device for manufacturing a biased mattress according to an embodiment of the invention.
Figure 6:
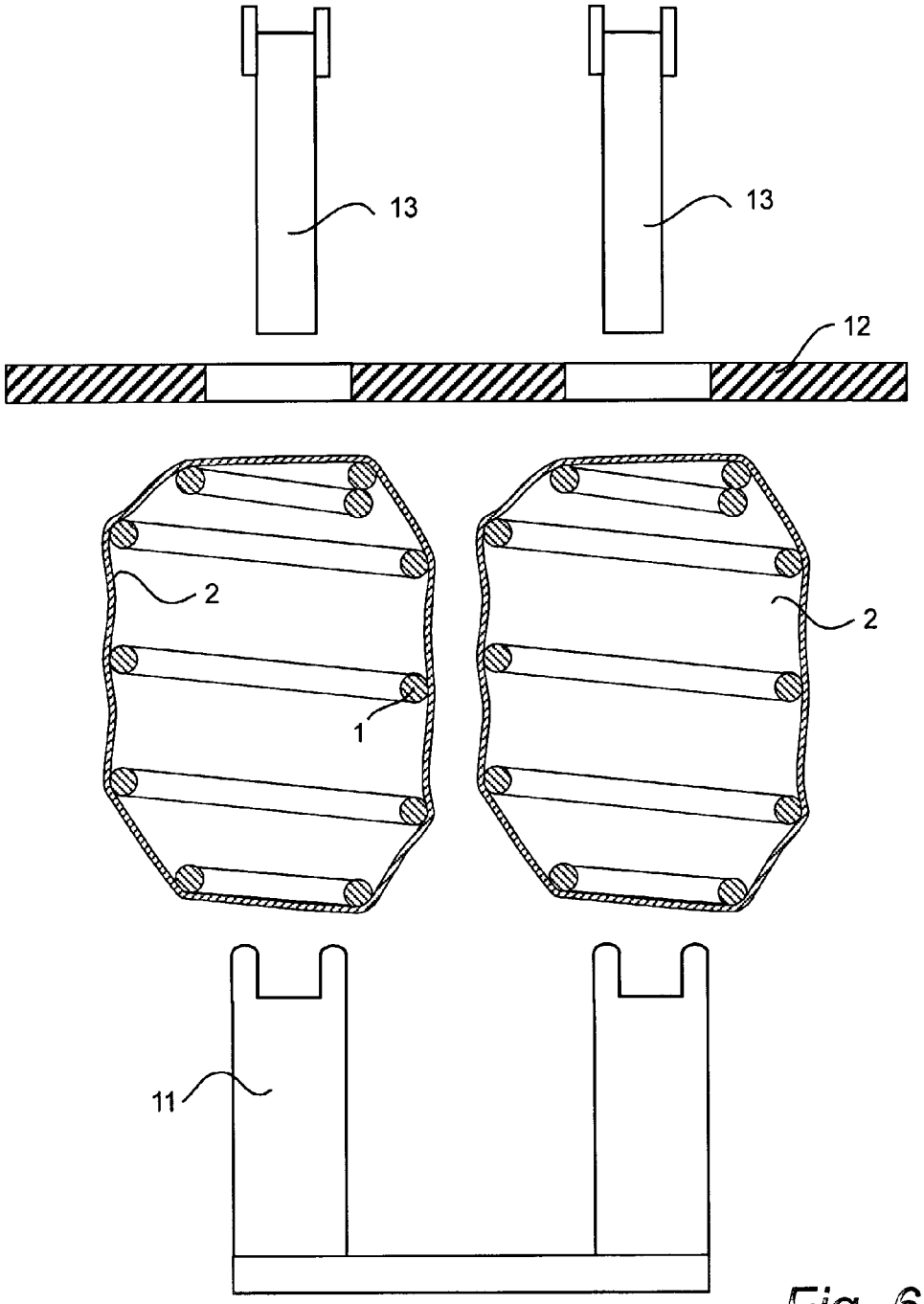
FIG. 6 is a schematic sectional view of the device in FIG. 5, seen from the side, with the insertion means in a non-inserted position.

A device for performing the bias according to the method above includes at least one insertion device 11 and, spaced therefrom, an abutment 12, as shown in FIGS. 5 and 6. In use, springs are arranged so that one spring end faces the insertion device and the other faces the abutment. The insertion device is movable towards and away from the abutment to move casing material at a spring end through the spring towards the casing material on the other side.

Moreover fixing devices 13 are provided for arranging connecting devices which connect the casing materials from the two ends. Preferably the insertion device is movable past the abutment, and the fixing device is arranged on the opposite side thereof, as shown in the embodiment. In this manner, the insertion device can move the casing material out of the front as well as the rear end through an opening in the abutment, while the abutment prevents the spring from being entrained. The fixing device can then fix the casing materials together by a mechanical connecting member, such as a clamp, or by a surface joint, such as gluing or welding.

A device for arranging the slots according to the method above may also include at least one cutting device 14, which can be moved down to the strings between the springs, as shown in FIG. 5. Alternatively, it is however also possible to insert the cutting device in a direction other than that shown in FIG. 5. The cutting device can be inserted in the longitudinal direction of the casings, in the transverse direction of the casings, or at any angle therebetween.

As discussed above, the slot-forming means can be arranged before or after the optional biasing device in a manufacturing device. The cutting device can advantageously be arranged in connection with the welding device that are used to form the casings, in which case the slots can be formed simultaneously with the welding or in direct connection thereto. The cutting device may include blades with a sharpened edge which can be moved down to the slots. Alternatively, cutting edges, which in the forming of the slot are moved towards each other, can be used instead. It is also conceivable to provide slots by heating or like operation.

A system according to an embodiment of the invention can advantageously comprise a plurality of parallel devices, such as two devices operating in parallel, which is shown in the embodiment.

It goes without saying that also other types of fixing device can be used for the bias. It is also possible to use a movable abutment, in which case means on both sides of the spring are pressed against each other, after which clamping, welding or like connection may occur. However, in this way the freedom of choosing the positioning of the fixing element will be smaller.

As mentioned above, the strings with springs are preferably arranged side by side, as indicated in FIGS. 3 and 4. Preferably, the rows are connected to each other at 2-3 fixing points vertically distributed just in front of each spring. Of course, a smaller or greater number of fixing points are conceivable. It is also possible to arrange a longer fixing line substantially parallel to the longitudinal direction of the springs instead of a plurality of shorter fixing points. The connection of strings to each other can occur by welding or gluing. Also this connection can, however, alternatively occur by means of clamps, by Velcro tape, or in some other suitable manner.

By way of the bias the height of the springs can easily be adjusted by varying the positioning of the fixing device. The more the casing portions from the ends are moved towards each other, and the more overlapping they are interconnected, the thinner and more compact the mattress. In this manner, it is also easy to provide different thicknesses of different portions of the mattress, or provide mattresses of different thicknesses, without needing to modify anything in the manufacturing process except the interconnection. The manufacture will in this way be very flexible and controllable.

The invention has been described above by way of embodiments. Several variants of the invention are, however, conceivable. For instance, as mentioned above, other types of fixing elements can be used, as well as other casing materials, spring sizes, different positioning and dimensioning of the slots etc. Furthermore the device and the method can be designed in other ways. Such obvious variants must be considered to be comprised by the invention as defined by the appended claims.

The invention claimed is:

1. A spring mattress, comprising:

a plurality of strings interconnected side by side, each string including a plurality of continuous casings and, enclosed therein, coil springs, casing portions arranged at the ends of the spring being moved towards each other, through the spring, and interconnected by at least one connecting device, said springs being biased within the casings, wherein, between at least some of the springs, in at least one of the strings, at least two slots are arranged between the springs, opening both towards the upper and lower side of the mattress.

2. A spring mattress as claimed in claim 1, wherein the at least two slots are arranged between substantially all springs in at least one of the strings.

3. A spring mattress as claimed in claim 1, wherein the springs between which the at least two slots are arranged are separated with an intermediate separation distance, which separation distance exceeds about 10% of the diameter of the largest turn of the adjoining springs.

4. A spring mattress as claimed in claim 3, wherein the separation distance is provided by a connection, extended in the longitudinal direction of the strings, of the casing material between the springs, the at least two slots being arranged in said extended connection.

5. A spring mattress as claimed in claim 3, wherein the separation distance is provided by two separated joint lines arranged between the springs, the at least two slots being arranged between said joint lines.

6. A spring mattress as claimed in claim 1, wherein the casing is a textile material.

7. A spring mattress as claimed in claim 1, wherein the casing portions are moved so far towards each other as to make contact with each other.

8. A spring mattress as claimed in claim 7, wherein the at least one connecting device includes at least one of a mechanical connecting element and a surface joint.

9. A spring mattress as claimed in claim 1, wherein the springs between which the at least two slots are arranged are separated with an intermediate separation distance, which separation distance exceeds 15% of the diameter of the largest turn of the adjoining springs.

10. A spring mattress as claimed in claim 1, wherein the springs between which the at least two slots are arranged are separated with an intermediate separation distance, which separation distance exceeds about 20% of the diameter of the largest turn of the adjoining springs.

11. A method for manufacturing a spring mattress, comprising:

enclosing springs in casings in continuous strings;

interconnecting the strings side by side;

biasing at least one of the springs by moving casing portions arranged for the ends of the spring towards each other and interconnecting the springs by connecting elements;

and, before or after the preceding steps, arranging at least two slots between at least some of the springs in at least one of the strings, said at least two slots open toward the upper and lower side of the mattress.

12. A method as claimed in claim 11, wherein at least some of the adjoining springs within a string, between which the at least two slots are arranged, are further arranged with an intermediate separation distance between the springs, said separation distance exceeding about 10% of the diameter of the largest turn of the adjoining springs.

13. A method as claimed in claim 12, wherein the casing portions are moved so far towards each other as to make contact with each other.

14. A method as claimed in claim 11, wherein the casing portions are moved so far towards each other as to make contact with each other.

15. A method as claimed in claim 11, wherein the at least two slots are arranged before the biasing of the springs.

16. A method as claimed in claim 11, wherein the separation of the springs is provided by arranging an interconnection, extended in the longitudinal direction of the strings, of the casing material, the at least two slots being arranged in said extended interconnection.

17. A method as claimed in claim 11, wherein the separation is provided by arranging two separated joint lines, the at least two slots being arranged between said joint lines.

18. A method as claimed in claim 11, wherein at least some of the adjoining springs within a string, between which at least two slots are arranged, are further arranged with an intermediate separation distance between the springs, said separation distance exceeding about 15% of the diameter of the largest turn of the adjoining springs.

19. A method as claimed in claim 11, wherein at least some of the adjoining springs within a string, between which at least two slots are arranged, are further arranged with an intermediate separation distance between the springs, said separation distance exceeding about 20% of the diameter of the largest turn of the adjoining springs.

20. A device for manufacturing spring mattresses, comprising:

means for enclosing coil springs in continuous casings to form strings;

means for interconnecting the strings side by side;

means for biasing the springs enclosed in the strings; and means for arranging at least two slots between springs in such strings, said at least two slots being open toward the upper and lower sides of the mattress.

21. A device as claimed in claim 20, wherein the means for biasing comprises at least one insertion device and, arranged at a distance therefrom, an oppositely extending device, the insertion device and the oppositely extending device being adapted to perform a relative displacement motion towards and away from each other to move casing materials, at the ends of a spring arranged therebetween, towards each other through the spring, and fixing means for arranging connecting elements which interconnect the thus moved together casing materials from the two ends of the spring.

* * * * *